US007448732B2

(12) United States Patent
Hori

(10) Patent No.: US 7,448,732 B2
(45) Date of Patent: Nov. 11, 2008

(54) LIQUID EJECTION HEAD AND MANUFACTURING METHOD THEREOF

(75) Inventor: Hisamitsu Hori, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 462 days.

(21) Appl. No.: 11/237,670

(22) Filed: Sep. 29, 2005

(65) Prior Publication Data

US 2006/0066689 A1 Mar. 30, 2006

(30) Foreign Application Priority Data

Sep. 30, 2004 (JP) ..... 2004-289163

(51) Int. Cl.
*B41J 2/045* (2006.01)

(52) U.S. Cl. ..... 347/68; 347/71

(58) Field of Classification Search ..... 347/68–72
See application file for complete search history.

(56) References Cited

U.S. PATENT DOCUMENTS

| | | | | |
|---|---|---|---|---|
| 5,940,099 | A | 8/1999 | Karlinski | |
| 6,270,193 | B1 * | 8/2001 | Hiwada | 347/50 |
| 6,439,702 | B1 | 8/2002 | Karlinski | |
| 6,481,074 | B1 | 11/2002 | Karlinski | |
| 6,616,270 | B1 | 9/2003 | Miyata et al. | |
| 6,688,732 | B2 * | 2/2004 | Mitsuhashi et al. | 347/70 |
| 6,766,567 | B2 | 7/2004 | Karlinski | |
| 2003/0088969 | A1 | 5/2003 | Karlinski | |
| 2003/0206218 | A1 | 11/2003 | Miyata et al. | |

FOREIGN PATENT DOCUMENTS

| | | | |
|---|---|---|---|
| JP | 2000-289201 | A | 10/2000 |
| JP | 2003-512211 | A | 4/2003 |
| JP | 2003-136721 | A | 5/2003 |
| WO | WO-01/30577 | A1 | 5/2001 |

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The liquid ejection head includes: a plurality of ejection ports which eject liquid; a plurality of pressure chambers which respectively communicate with the ejection ports; a plurality of piezoelectric elements which respectively deform the plurality of pressure chambers and are provided to faces of the pressure chambers opposite to faces on which the ejection ports are formed; a common liquid chamber which supplies the liquid to the plurality of pressure chambers and is formed on a side of the piezoelectric element opposite to the pressure chamber; a plurality of through-hole wires which stand substantially perpendicular to the faces on which the piezoelectric elements are mounted, the through-hole wires running through a partition wall of the common liquid chamber and being electrically connected to the piezoelectric elements in connecting portions, respectively; and a spherical member which has a conductive coating and is disposed in each of the connecting portions, wherein a recess is formed on a side of the piezoelectric element facing the through-hole wire in each of the connecting portions.

10 Claims, 12 Drawing Sheets

LIQUID EJECTION HEAD AND MANUFACTURING METHOD THEREOF

BACKGROUND OF THE INVENTION

1. Field of the Invention

The present invention relates to a liquid ejection head and a manufacturing method thereof, and particularly relates to a technique for connecting electrical wires in a high-density liquid ejection head.

2. Description of the Related Art

A known example of an image forming apparatus is an inkjet printer (inkjet recording apparatus) that has an inkjet head (liquid ejection head) with multiple nozzles (ejection ports) arrayed, wherein an image is recorded on a recorded medium by ejecting ink from the nozzles onto the recorded medium while moving the inkjet head and the recorded medium relative to each other.

Such an inkjet printer is designed so that ink is supplied from an ink tank to pressure chambers via an ink supply channel, and a piezoelectric element is driven by sending electric signals corresponding to image data to the piezoelectric element, whereby a diaphragm constituting part of the pressure chambers is deformed, the capacity of the pressure chambers is reduced, and the ink in the pressure chambers is ejected from the nozzles as droplets.

In such an inkjet printer, one image is formed on the recorded medium by combining dots formed by the ink ejected from the nozzles. Recently there has been a demand for forming high quality images to ensure photographic print quality in inkjet printers. One technique under consideration is to achieve high quality by reducing the nozzle size to shrink the size of the ink droplets ejected from the nozzles, and arraying the nozzles in a highly dense arrangement to increase the number of pixels per unit area.

Also, in order to densely array the nozzles, a structure for the electrical wires for driving the nozzles and a method for connecting the electrodes must be designed. Various proposals have been made concerning this matter.

In one known example, high density and low cost are achieved by disposing the nozzles on the side of the piezoelectric element, using a configuration in which an aluminum plug runs through the layered layers, and a head is formed by silicon photoetching (for example, see Japanese Patent Application Publication No. 2000-289201).

Also, in another known example, an inkjet head is provided with excellent refilling capabilities, ink mixing capabilities, and filterability. In this head, sintered stainless steel or another such porous material with multiple small internally connected holes is used as the ink supply plate to enable ink to pass through this portion (for example, see Japanese Patent Application Publication No. 2003-512211).

Also, in another known example, the structure is simplified by connecting driving wires to a mounting unit provided in the area on the side opposite the piezoelectric element (for example, see Japanese Patent Application Publication No. 2003-136721).

However, the example disclosed in Japanese Patent Application Publication No. 2000-289201 has drawbacks in that although a configuration is used in which an aluminum plug passes through the layered layers, silicon photoetching makes it difficult to form deep electrodes and to increase the size of the head.

The example disclosed in Japanese Patent Application Publication No. 2003-512211 has drawbacks in that although a configuration is used in which bumps are formed on both sides of an insulating plate and pressure is applied to the piezoelectric element with an elastic pad to bring out the electrodes, it is difficult to achieve high density and the connection tends to become unstable.

Furthermore, the example disclosed in Japanese Patent Application Publication No. 2003-136721 has drawbacks in that because the wires are connected with the disclosed wiring pattern and wire bonding and the electrodes are brought out in a thin film, it is difficult to form thin and deep wires.

SUMMARY OF THE INVENTION

The present invention has been contrived in view of such circumstances, and an object thereof is to provide a liquid ejection head and a manufacturing method thereof in which the structure for connecting multiple electrical wires can be efficiently formed, the reliability and precision of the connection can be improved, and higher packaging density can be achieved.

In order to attain the aforementioned object, the present invention is directed to a liquid ejection head, comprising: a plurality of ejection ports which eject liquid; a plurality of pressure chambers which respectively communicate with the ejection ports; a plurality of piezoelectric elements which respectively deform the plurality of pressure chambers and are provided to faces of the pressure chambers opposite to faces on which the ejection ports are formed; a common liquid chamber which supplies the liquid to the plurality of pressure chambers and is formed on a side of the piezoelectric element opposite to the pressure chamber; a plurality of through-hole wires which stand substantially perpendicular to the faces on which the piezoelectric elements are mounted, the through-hole wires running through a partition wall of the common liquid chamber and being electrically connected to the piezoelectric elements in connecting portions, respectively; and a spherical member which has a conductive coating and is disposed in each of the connecting portions, wherein a recess is formed on a side of the piezoelectric element facing the through-hole wire in each of the connecting portions.

The connecting structure of rod-shaped electrical wires with a high aspect ratio can thereby be efficiently achieved, and the productivity can be improved. Furthermore, since a recess is formed on the side of the piezoelectric element in the connecting portions, inserting the spherical member having a conductive coating via the through-hole allows misalignments resulting from any mistakes in the alignment between the through-hole wiring portion and the piezoelectric element side to be absorbed to achieve a reliable connection, and the reliability and precision of the connection can be improved.

Preferably, a center position of the recess is placed a specific distance from an axial position of the through-hole wire.

The spherical member can thereby be ensured to always protrude in one direction without inclining the head, and a reliable connection with satisfactory operability can be achieved.

Preferably, an inequality $W<D<d$ is satisfied between a diameter d of a through-hole formed in the partition wall of the common liquid chamber in which the through-hole wire is formed, a diameter D of the spherical member, and a connecting width W which is a distance between a point at which the spherical member is in contact with the piezoelectric element in the connecting portion, and a point at which the spherical member is in contact with the through-hole wire in the connecting portion.

The connection with the spherical member can thereby be made even more reliable.

Preferably, a portion in which the through-hole wire comes into contact with the spherical member has a projection shape.

The gap between the through-hole and the connecting portion on the piezoelectric element side can thereby be reduced even when the through-hole is formed near the piezoelectric element. Therefore, a connection is possible with a smaller spherical member, and high density can be achieved.

In order to attain the aforementioned object, the present invention is also directed to a liquid ejection head, comprising: a plurality of ejection ports which eject liquid; a plurality of pressure chambers which respectively communicate with the ejection ports; a plurality of piezoelectric elements which respectively deform the plurality of pressure chambers and are provided to faces of the pressure chambers opposite to faces on which the ejection ports are formed; a common liquid chamber which supplies the liquid to the plurality of pressure chambers and is formed on a side of the piezoelectric element opposite to the pressure chamber; a plurality of through-holes which stand from connecting portions of the piezoelectric elements substantially perpendicularly to the faces on which the piezoelectric elements are mounted, the through-holes running through a partition wall of the common liquid chamber; and a plurality of spherical members which are disposed in each of the through-holes, each of the spherical members having a conductive coating, wherein a recess is formed on a side of the piezoelectric element facing the through-hole in each of the connecting portions.

It is thereby possible to bring out the electrodes from the side of the piezoelectric element even if the through-hole is not electrically conductive.

In order to attain the aforementioned object, the present invention is also directed to a liquid ejection head, comprising: a plurality of ejection ports which eject liquid; a plurality of pressure chambers which respectively communicate with the ejection ports; a plurality of piezoelectric elements which respectively deform the plurality of pressure chambers and are provided to faces of the pressure chambers opposite to faces on which the ejection ports are formed; a common liquid chamber which supplies the liquid to the plurality of pressure chambers and is formed on a side of the piezoelectric element opposite to the pressure chamber; a plurality of pressure determination elements which determine pressure in the pressure chambers, respectively; a plurality of through-hole wires which stand substantially perpendicular to the faces on which the piezoelectric elements are mounted, the through-hole wires running through a partition wall of the common liquid chamber and being electrically connected to the pressure determination elements in connecting portions, respectively; and a spherical member which has a conductive coating and is disposed in each of the connecting portions, wherein a recess is formed on a side of the pressure determination element facing the through-hole wire in each of the connecting portions.

The connection and the electrode lead not only from the piezoelectric element but also from the pressure determination element can thereby be made more reliable and efficient, precision can be improved, and high density can be achieved.

In order to attain the aforementioned object, the present invention is also directed to a liquid ejection head, comprising: a plurality of ejection ports which eject liquid; a plurality of pressure chambers which respectively communicate with the ejection ports; a plurality of piezoelectric elements which respectively deform the plurality of pressure chambers and are provided to faces of the pressure chambers opposite to faces on which the ejection ports are formed; a common liquid chamber which supplies the liquid to the plurality of pressure chambers and is formed on a side of the piezoelectric element opposite to the pressure chamber; a plurality of pressure determination elements which determine pressure in the pressure chambers, respectively; a plurality of through-holes which stand from connecting portions of the pressure determination elements substantially perpendicularly to the faces on which the piezoelectric elements are mounted, the through-holes running through a partition wall of the common liquid chamber; and a plurality of spherical members which are disposed in each of the through-holes, each of the spherical members having a conductive coating, wherein a recess is formed on a side of the pressure determination element facing the through-hole in each of the connecting portions.

Electrodes can thereby be brought out from the pressure determination element even if the through-hole is not electrically conductive.

In order to attain the aforementioned object, the present invention is also directed to a method for manufacturing a liquid ejection head, comprising: a step of forming through-holes in portions of a flow channel plate which forms a common liquid chamber for supplying liquid to pressure chambers communicated with ejection ports, the portions facing a partition wall of the common liquid chamber; a conductive treatment step of forming conductive material on inner walls of the through-holes; a step of applying an electrically conductive agent to at least one of mutually connecting portions between connecting portions of the through-holes, connecting portions of piezoelectric elements for respectively deforming the pressure chambers, and spherical members for respectively connecting between the connecting portions of the through-holes and the connecting portions of the piezoelectric elements; a step of bonding a top layer of the liquid ejection head forming the common liquid chamber, and a bottom layer of the liquid ejection head including the pressure chambers; a step of inserting the spherical members from the through-holes; and a step of heating the electrically conductive agent or directing light via the through-holes for melting the electrically conductive agent, curing the electrically conductive agent, and connecting the spherical members between the connecting portions of the through-holes and the connecting portions of the piezoelectric elements.

Multiple through-hole wires can thereby be efficiently connected, the reliability and precision of the connection can be improved, and higher packaging density can be ensured.

In order to attain the aforementioned object, the present invention is also directed to a method for manufacturing a liquid ejection head, comprising: a step of forming through-holes in portions of a flow channel plate which forms a common liquid chamber for supplying liquid to pressure chambers communicated with ejection ports, the portions facing a partition wall of the common liquid chamber; a step of bonding a top layer of the liquid ejection head including the common liquid chamber, and a bottom layer of the liquid ejection head including the pressure chambers; a step of applying an electrically conductive agent to portions in which the through-holes and connecting portions of piezoelectric elements for respectively deforming the pressure chambers are electrically connected to each other; inserting a plurality of spherical members having electrical conductivity from the through-holes; and curing the electrically conductive agent.

It is thereby possible to easily manufacture a liquid ejection head in which electrodes can be brought out using a plurality of conductive spherical members when the through-hole is not electrically conductive.

As described above, the liquid ejection head and manufacturing method thereof according to the present invention involves forming recesses on the side of the piezoelectric element in the connecting portions. Therefore, when the spherical members having conductive coatings are inserted from the through-hole, misalignments resulting from any mistakes can be absorbed to achieve a reliable connection, multiple connections with the through-hole wire can be efficiently achieved, the reliability and precision of the connections can be improved, and higher packaging density can be ensured.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
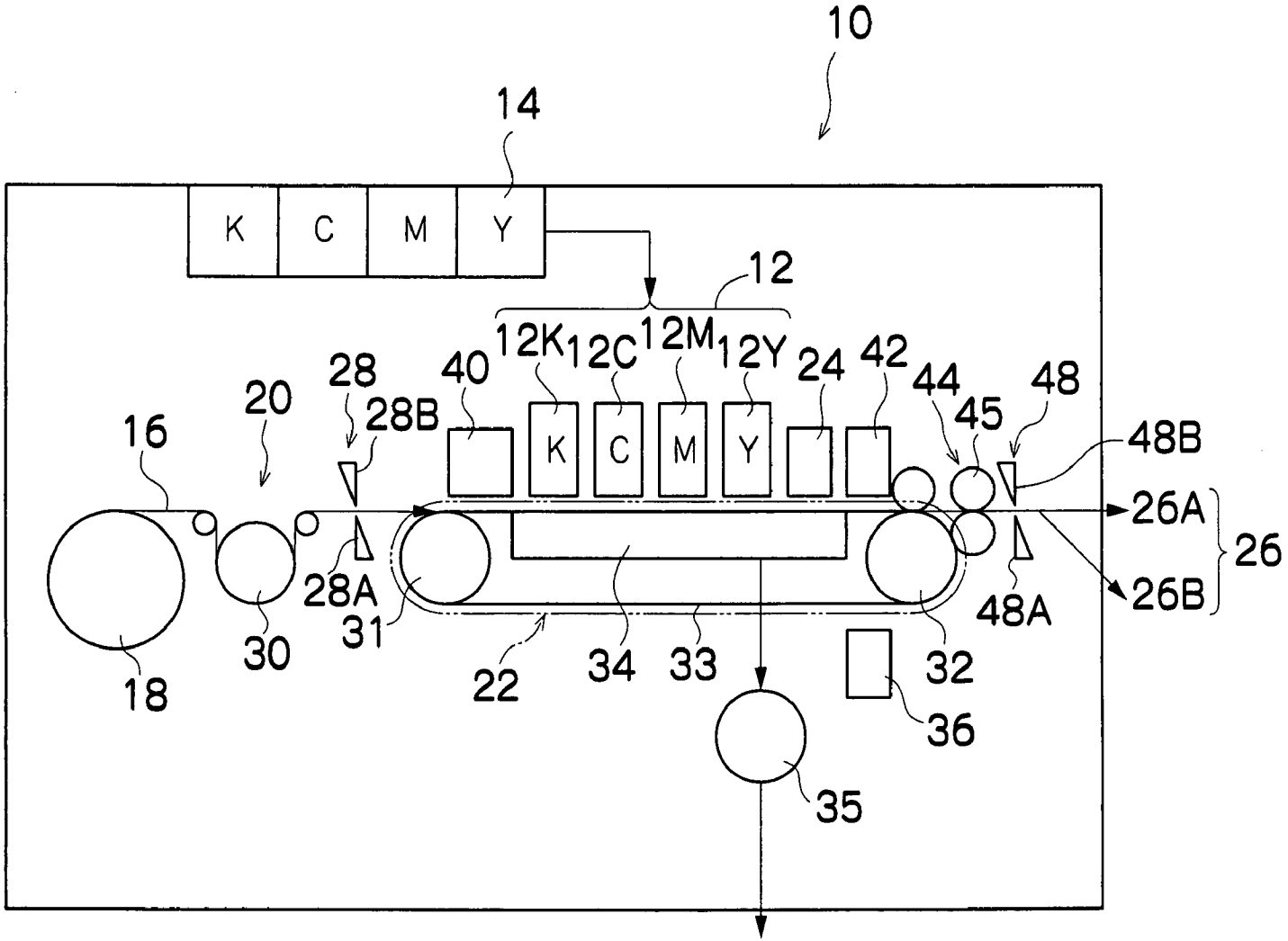
FIG. 1 is a general schematic drawing showing an overview of a first embodiment of an inkjet recording apparatus as an image forming apparatus having a liquid ejection head according to the present invention.

FIG. 1 is a general schematic drawing showing an overview of an embodiment of an inkjet recording apparatus as an image forming apparatus having the liquid ejection head according to the present invention.

As shown in FIG. 1, the inkjet recording apparatus 10 comprises a print unit 12 having a plurality of print heads (liquid ejection heads) 12K, 12C, 12M, and 12Y provided for each ink color; an ink storing/loading unit 14 for storing the ink to be supplied to the print heads 12K, 12C, 12M, and 12Y; a paper supply unit 18 for supplying recording paper 16; a decurling unit 20 for removing curls from the recording paper 16; an adsorption belt conveyance unit 22 that is disposed facing the nozzle surface (ink ejection surface) of the print unit 12 for conveying the recording paper 16 while maintaining the flatness of the recording paper 16; a print determination unit 24 for reading the printing results of the print unit 12; and a paper ejection unit 26 for ejecting the recording paper after printing (the printed object) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of an apparatus configuration that uses rolled paper, a cutter 28 is provided for cutting, and the rolled paper is cut to the desired size by this cutter 28 as shown in FIG. 1. The cutter 28 is configured from a fixed blade 28A with a length equal to or greater than the width of the conveyed path of the recording paper 16, and a round blade 28B that moves along the fixed blade 28A, wherein the fixed blade 28A is provided to the reverse side of printing, and the round blade 28B is disposed on the printed side with the conveyed path in between. When cut paper is used, the cutter 28 is not needed.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
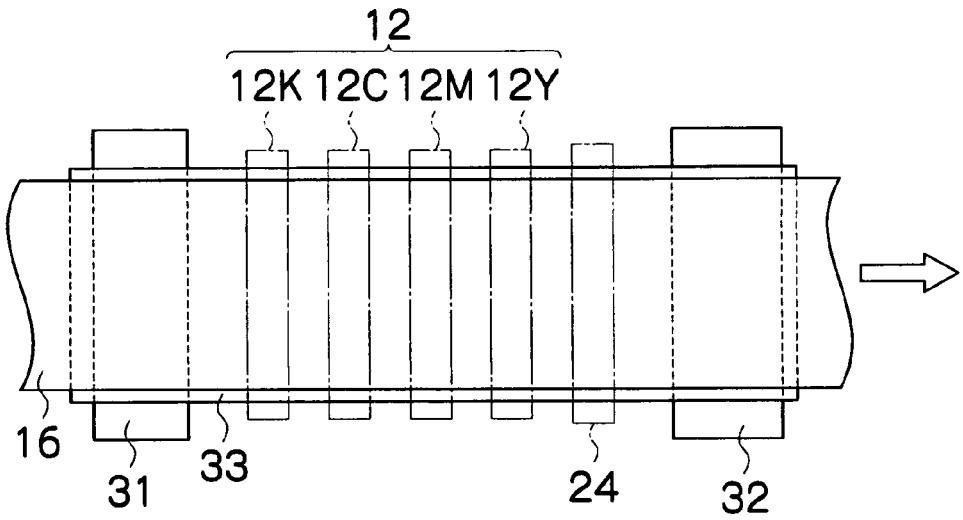
FIG. 2 is a plan view of a principal component of the periphery of the print unit in the inkjet recording apparatus shown in FIG. 1.

The print unit 12 is a so-called full-line head, in which the line head with a length corresponding to the maximum paper width is disposed in a direction (main scanning direction) orthogonal to the direction of conveyance (sub-scanning direction) (see FIG. 2).

As shown in FIG. 2, the print heads 12K, 12C, 12M, and 12Y are configured with a full-line head in which a plurality of ink ejection ports (nozzles) are arrayed across a length exceeding at least one side of the maximum-size recording paper 16 that can be used in the inkjet recording apparatus 10.

The print heads 12K, 12C, 12M, and 12Y corresponding to the ink colors are disposed from the upstream side (left side in FIG. 1) along the direction in which the recording paper 16 is conveyed (paper conveyance direction) in the order of black (K), cyan (C), magenta (M), and yellow (Y). A color image can be formed on the recording paper 16 by ejecting the colored ink from each of the print heads 12K, 12C, 12M, and 12Y while conveying the recording paper 16.

Thus, with a print unit 12 in which a full-line head that covers the entire paper width is provided for each ink color, an image can be recorded over the entire surface of the recording paper 16 by a single cycle in which the recording paper 16 and the print unit 12 are moved relative to each other in the paper conveyance direction (sub-scanning direction) (specifically, by one sub-scanning). It is thereby possible to print at higher speeds than with a shuttle head in which the print head is moved back and forth in the direction (main scanning direction) orthogonal to the paper conveyance direction, and productivity can be improved.

The terms "main scanning direction" and "sub-scanning direction" are used with the following meanings. When the nozzles are driven with a full-line head that has a nozzle row corresponding to the entire width of the recording paper, (1) all the nozzles are driven simultaneously, (2) the nozzles are driven sequentially from one side to the other, (3) the nozzles are grouped into blocks, or another drive mode is used, and the blocks are driven sequentially from one side to the other. Driving the nozzles so that a single line (a line of a single row of dots or a line composed of a plurality of dot rows) is printed in the width direction of the paper (the direction orthogonal to the direction in which recording paper is conveyed) is defined as main scanning. The direction of a single line (longitudinal direction of a belt-shaped region) recorded by main scanning is referred to as the main scanning direction.

Repeating the printing of a single line (a line of a single row of dots or a line composed of a plurality of dot rows) formed by main scanning by moving the full-line head and the recording paper relative to each other is defined as sub-scanning. The direction in which sub-scanning is performed is referred to as the sub-scanning direction. Therefore, the direction in which recording paper is conveyed is the sub-scanning direction, and the direction orthogonal thereto is the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added. Furthermore, there are no particular restrictions of the sequence in which the print heads of respective colors are arranged.

As shown in FIG. 1, the ink storing/loading unit 14 has tanks for storing colored ink corresponding to the print heads 12K, 12C, 12M, and 12Y, and the tanks are communicated with the print heads 12K, 12C, 12M, and 12Y via tubes (not shown in the diagram). Also, the ink storing/loading unit 14 includes a notification device (display device, warning sound device) for notifying the user when the remaining ink is running low, and also has a mechanism for preventing loading errors between colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed by the print heads 12K, 12C, 12M, and 12Y of each color, and determines the ejection of each head. This ejection determination involves determining whether the heads have ejected, measuring the dot size, and measuring the positions in which the dots have been deposited.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Next, the arrangement of nozzles (liquid ejection ports) in the print head (liquid ejection head) will be described. Since the print heads 12K, 12C, 12M, and 12Y provided for each ink color have a common structure, a print head will be denoted by the reference numeral 50 as a representative example, and a perspective plan view of the print head 50 is shown in FIG. 3.

Figure 3:
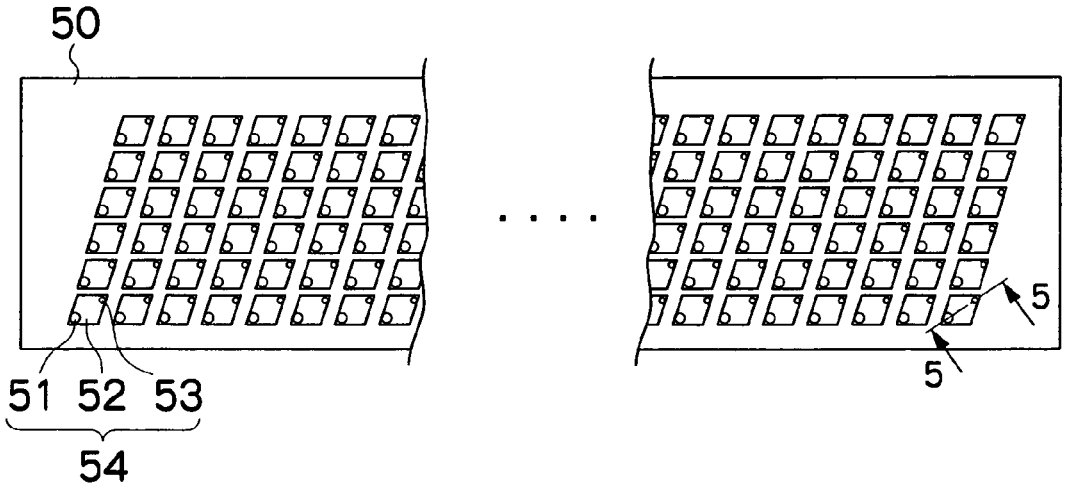
FIG. 3 is a perspective plan view showing a structural example of a print head.

In the print head 50 of the present embodiment, pressure chamber units 54, which are configured from nozzles 51 for ejecting ink as droplets, pressure chambers 52 for applying pressure to the ink when the ink is ejected, and ink supply ports 53 for supplying ink to the pressure chambers 52 from a common flow channel (not shown in FIG. 3), are arrayed in a staggered two-dimensional matrix pattern, ensuring high density in the nozzles 51, as shown in FIG. 3.

The size of the nozzle arrangement on such a print head 50 is not particularly limited, and as one example, 2400 npi is achieved by arraying the nozzles 51 is columns of 48 widthwise (21 mm) and rows of 600 lengthwise (305 mm).

In the example shown in FIG. 3, the planar shape of the pressure chambers 52 is substantially square as seen from above, but the planar shape of the pressure chambers 52 is not limited to a square, and may be a diamond or an ellipse. In the pressure chambers 52, the nozzles 51 are formed at one end of the diagonal, and the ink supply ports 53 are formed at the other end, as shown in FIG. 3.

Figure 4:
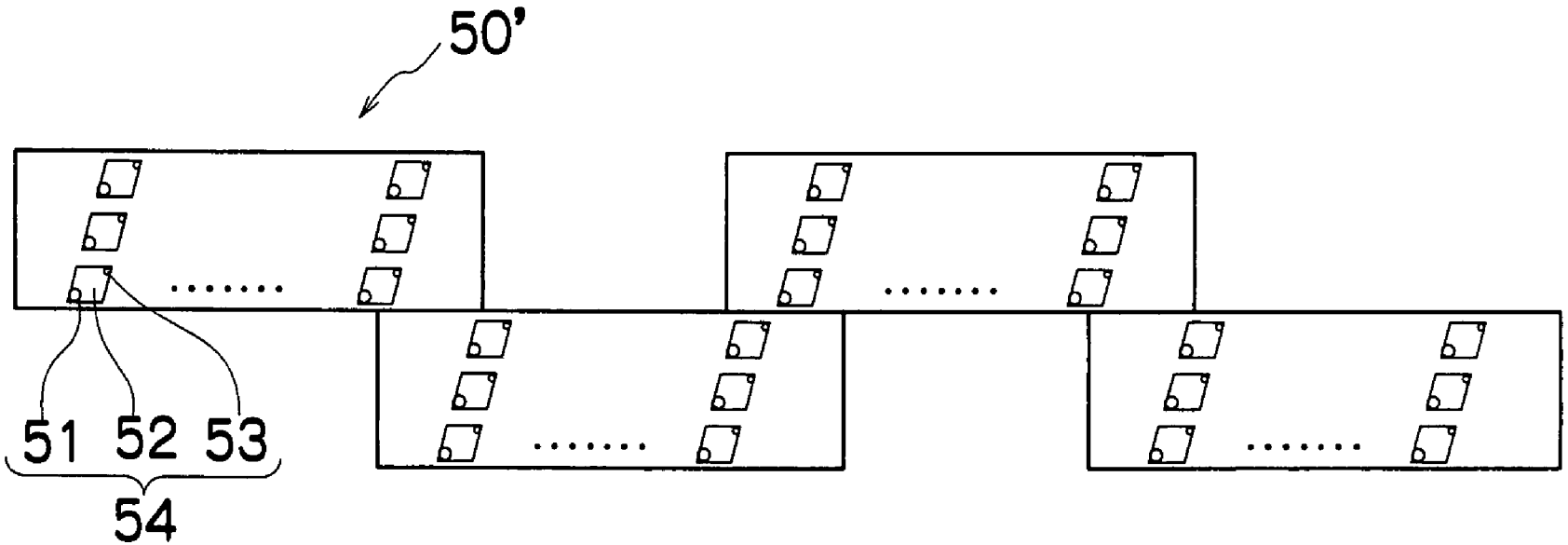
FIG. 4 is a plan view showing another example of a print head.

FIG. 4 is a perspective plan view showing a structural example of another print head. As shown in FIG. 4, a plurality of rectangular heads 50' are joined in a two-dimensional staggered array, and a single long rectangular full-line head may be configured with all of these rectangular heads 50' to extend over a length corresponding to the entire width of the printing medium.

Figure 5:
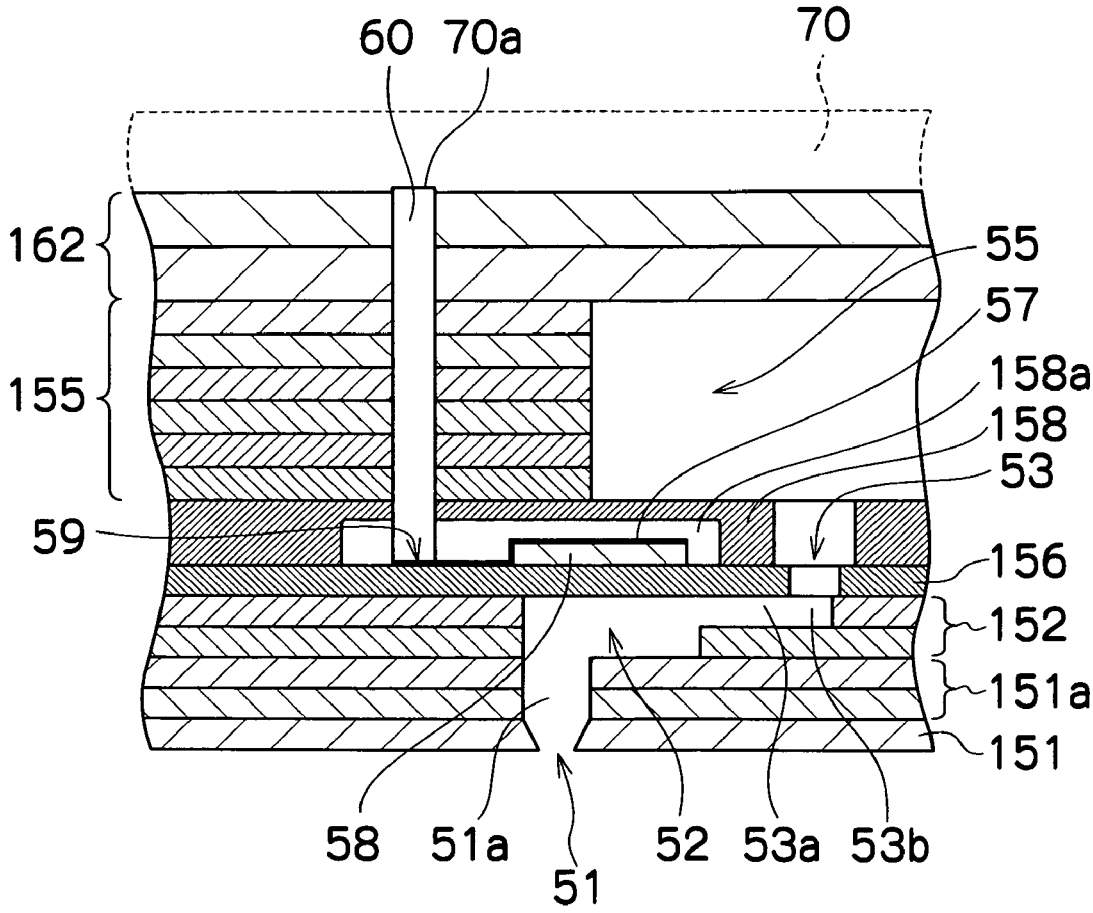
FIG. 5 is a cross-sectional view showing an enlargement of part of the print head of the embodiment of the present invention.

FIG. 5 is a cross-sectional view along the line 5-5 in FIG. 3.

As shown in FIG. 5, the print head 50 according to the present embodiment is formed with a structure of layered thin plates. First, a nozzle plate 151 in which the nozzles (nozzle holes) 51 are formed is disposed on the lowest layer of the print head 50. The nozzle plate 151 is made, for example, by performing a liquid repellant treatment on a product obtained by pressing a thin stainless steel plate using half die cutting, and polishing the resulting plate; a product obtained nickel electroforming; a product obtained by abrading a polyimide material with an excimer laser; or the like. Also, the nozzles (nozzle holes) 51 are preferably formed into a reverse tapered shape so that the diameter decreases towards the ink ejection side (the outer side).

Next, a nozzle flow channel plate 151*a* on which the nozzle flow channel 51*a* is formed is layered on the nozzle plate 151. Aside from the print determination unit 24 that determines ejection on the outside of the print head 50, a sensor plate as a pressure sensor for determining ejections in the print head 50 may instead be used as the nozzle flow channel plate 151*a*. A preferred example of a sensor plate is one with polyvinylidene fluoride (PVDF) layered over stainless steel.

A pressure chamber plate 152 for forming the pressure chamber 52 is layered over the nozzle flow channel plate 151*a*. The pressure chamber plate 152 may be formed by layering products obtained by the multistep etching of stainless steel, or products obtained by etching stainless steel on both sides. An opening for the pressure chamber 52, a supply aperture 53*a*, an ink supply port 53*b*, and an ink supply flow channel 53 are formed in the pressure chamber plate 152. Also, though not shown in the diagram, escape grooves or the like for the adhesive are formed in the pressure chamber plate 152 as necessary to allow the adhesive to flow so that an excessive amount of adhesive does not overflow and block up the pressure chamber 52 or the ink supply flow channel 53 when the pressure chamber plate 152 is bonded.

A diaphragm 56 is layered over the pressure chamber plate 152 by epoxy bonding or the like. A piezoelectric element 58 is disposed at a position corresponding to the pressure chambers 52 on the diaphragm 56. The piezoelectric element 58 is used by being mechanically separated aver a common electrode is attached by sputtering on a baked and polished surface. An individual electrode 57 is formed on the top side of the piezoelectric element 58, from which an electrode pad 59 is formed by being brought out horizontally.

Next, a piezo cover 158 is layered over the diaphragm 56 with the piezoelectric element 58. The piezo cover 158 is formed by the wet etching of a stainless steel thin plate, for example, and is designed particularly so that the portion facing the position of the piezoelectric element 58 is half-die cut by half etching to form a hollow cavity 158*a* to prevent the piezoelectric element 58 from being obstructed during layering. The reason that the portion of the piezo cover 158 facing the piezoelectric element 58 is half etched to form a hollow cavity 158*a* is to cover the piezoelectric element 58 to protect the element from the ink, and to stabilize the driving of the piezoelectric element 58 by separating the element from the ink, and also to maintain damping characteristics and to reduce crosstalk.

A flow channel plate 155 for forming a common liquid chamber 55 for supplying ink to the plurality of pressure chambers 52 is layered over the piezo cover 158. The flow channel plate 155 has an opening for the common liquid chamber 55, and is formed by the wet etching of a stainless steel thin plate, for example.

A base plate 162 that constitutes the ceiling of the common liquid chamber 55 and that forms the main flow of the ink flow channel for supplying ink to the common liquid chamber 55 from the ink tank (not shown in the diagram) is layered over the flow channel plate 155. Also, as shown by the dashed line in the diagram, a multilayered flexible cable 70 is bonded over the base plate 162.

An electrical wire (through-hole wire) 60 for supplying a signal to drive the piezoelectric element 58 stands substantially perpendicular to the surface containing the piezoelectric element 58 from the electrode pad 59 brought out from the individual electrode 57 on the piezoelectric element 58, and passes through the partition wall of the common liquid chamber 55 formed from the layered structure of the flow channel plate 155 and the base plate 162. The top of the electrical wire 60 is connected to the multilayered flexible cable 70 by an electrode pad 70*a*.

The present invention provides a method for manufacturing the electrical wire 60 and a method for bonding the electrode pad 59 on the side of the piezoelectric element 58. These methods are described hereinbelow.

Figure 6:
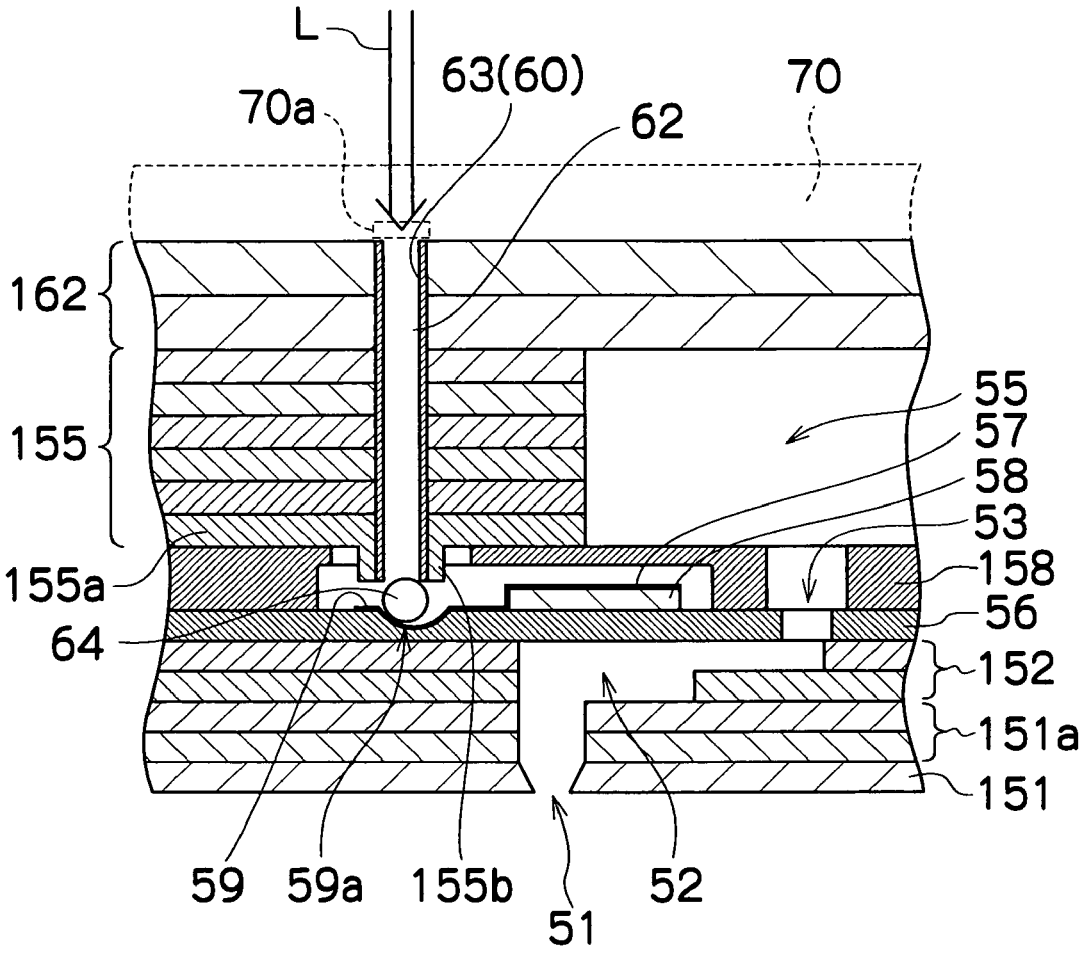
FIG. 6 is a cross-sectional view showing the details of an electrode connecting portion in the electrical wires.

FIG. 6 shows the detailed configuration of the electrical wire (through-hole wire) 60 and the portion in which the electrical wire 60 and the electrode pad 59 connect.

As shown in FIG. 6, in order to form the electrical wire 60, a through-hole 62 is formed so as to pass substantially vertically through the plates in the partition wall of the common liquid chamber 55 formed by layering the flow channel plate 155 and the base plate 162. The through-hole 62 is formed so as to establish an electrical connection from the multilayered flexible cable 70 (the electrode pad 70*a* thereof) to the electrode pad 59 on the side of the piezoelectric element 58. The through-hole 62 is formed by forming a specific opening in the plates before the plates are layered, and a substantially orthogonal hole 62 may be formed in the plates by layering the plates.

The inner surface of the through-hole 62 is insulated and is rendered electrically conductive by a plating 63, for example. An electrical wire (through-hole wire) 60 of which center is a hollow circular tube is formed by the plating 63 on the inner wall of the through-hole 62. Also, a rib-shaped projection 155*b* is formed around the through-hole 62 on a plate 115*a* on the lowest layer of the flow channel plates 155 by pressing or etching.

A ball (spherical member with conductive coating) 64, which has a specific diameter and of which surface has been plated with solder, is inserted from the top of the through-hole 62 into the hollow part of the through-hole 62 so as to form connections with the electrode pad 59 and the plating 63 on the projection 155*b* of the lowest plate 155*a*, then laser light L is irradiated to the ball 64 from above, thereby the solder on the surface of the ball 64 is melted to form an electrical connection in the corresponding portions, and thus the electrode pad 59 on the side of the piezoelectric element 58 and the electrical wire (through-hole wire) 60 are connected.

A conical recess 59*a* is formed in the electrode pad 59 so that the ball 64 will form a reliable contact with both the projection 155*b* of the lowest plate 155*a* and the electrode pad 59.

Figure 7:
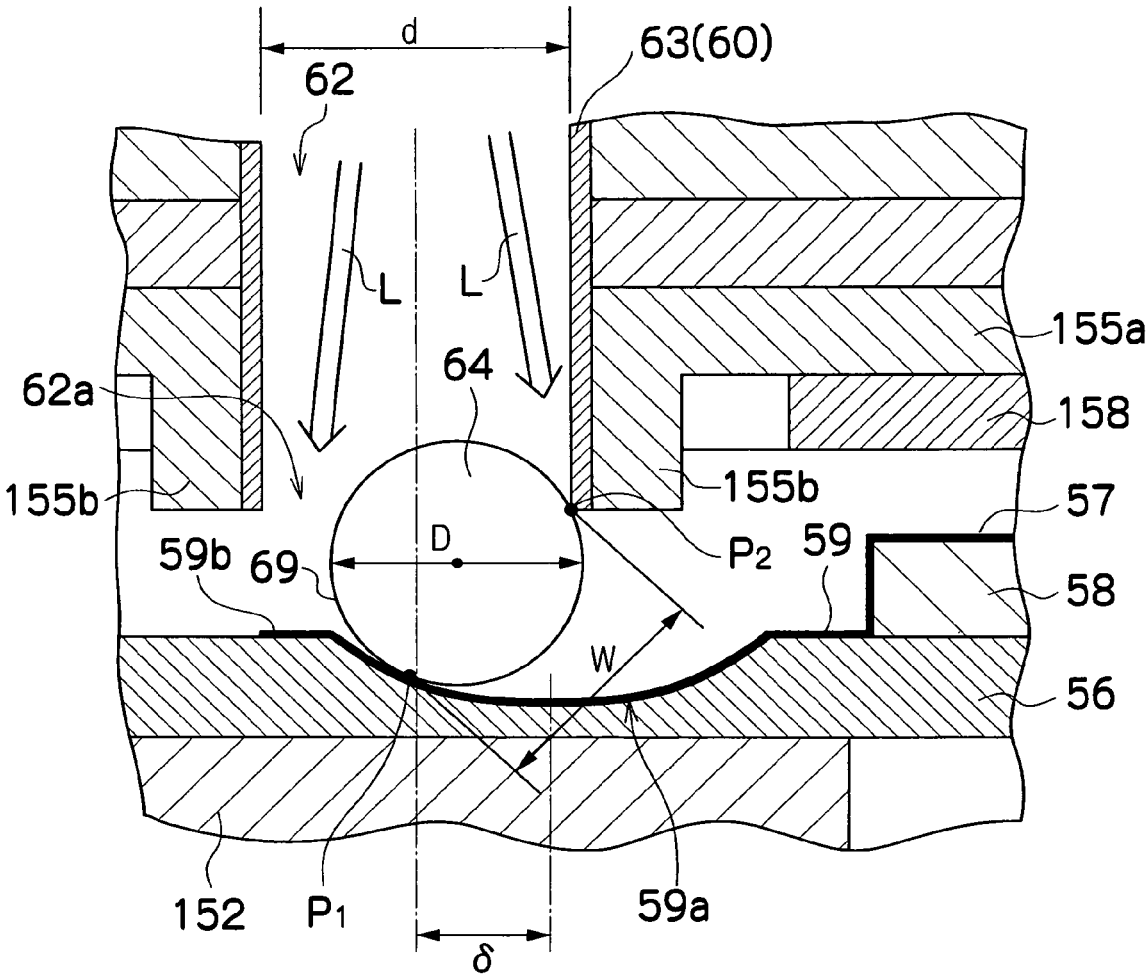
FIG. 7 is a cross-sectional view showing an enlargement of the electrode connecting portion in FIG. 6.

FIG. 7 shows an enlargement of the section connecting with the electrode pad 59.

As shown in FIG. 7, the diameter D of the ball 64 must naturally be smaller than the diameter d of the through-hole 62 in order for the ball 64 to be inserted into the through-hole 62. Also, the conical recess 59*a* in the electrode pad 59 is formed so that the lowest point thereof (the center of the recess 59*a*) is separated from the center of the through-hole 62 by a distance δ. Therefore, the ball 64 inserted from the top of the through-hole 62 is designed to move towards the lowest point of the conical recess 59*a* when the ball comes into contact with the electrode pad 59.

At this time, the relative height between the recess 59*a* and the distal end of the projection 155*b* provided to the lowest plate 155*a* of the flow channel plates 155 is set at a specific level, whereby the ball 64 is prevented from coming into contact with the projection 155*b* in the middle when moving over the recess 59*a*.

As a result, the ball 64 comes into contact with the recess 59*a* of the electrode pad 59 at point P1, and also comes into contact with the area of the plating 63 in the projection 155*b* of the lowest plate 155*a* for forming the electrical wire (through-hole wire) 60 at point P2. Thus, since the ball 64 stops in the middle of the recess 59*a* while misaligned to one side from the center of the through-hole 62, a gap 62*a* is formed between the lowest plate 155*a* and the projection 155*b* on the side opposite the side of contact.

Assuming that the distance between the points P1 and P2 (equivalent to the width of the connection) is designated as W, this distance must be less than the diameter D of the ball 64. Therefore, a relationship of the following inequality (1) must be established between the diameter d of the through-hole 62, the diameter D of the ball 64, and the connection width W in order for the ball 64 that has fallen into the through-hole 62 from above to stop in the middle of the recess 59*a* of the electrode pad 59, and in order to ensure an electrical connection while a gap 62*a* is formed on the side opposite the side in which the ball comes into contact in at least two contact points, including the contact point P1 with the electrode pad 59 and the contact point P2 with the lowest plate 155*a* (the electrical wire 60):

$$W<D<d. \quad (1)$$

After the ball 64 is inserted in this manner, laser light L is directed from the top of the through-hole 62, whereupon the laser light L strikes the portion of the electrode pad 59*b* exposed to the laser light because of the gap 62*a* described above, and the point P1 is efficiently heated by the thermal conductivity of the electrode pad 59. Since the laser light L also strikes the point P2, the solder plating 69 coating the surface of the ball 64 melts, and a connection resulting form the solder is established in the points P1 and P2. A reliable electrical connection is thereby established between the electrode pad 59 and the electrical wire 60 formed on the plating 63 section formed on the inner sides of the through-hole 62.

Figure 8:
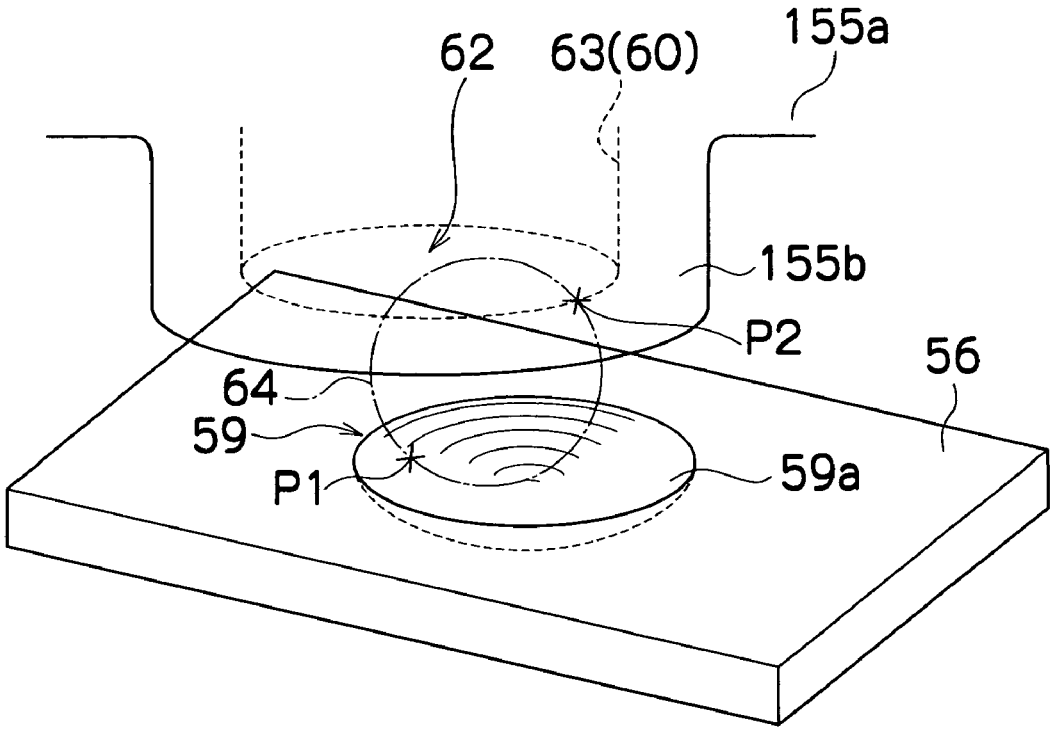
FIG. 8 is a perspective view showing the shape of a recess in an electrode connecting portion.

FIG. 8 shows a perspective view of the manner in which the electrode pad 59 and the electrical wire 60 are connected by the ball 64.

As shown in FIG. 8, the ball 64 comes into contact with the points P1 and P2 of the electrode pad 59 and electrical wire 60 in the middle of the conical recess 59*a*. In order for the ball 64, which is the spherical member, to come into contact with both points, the radius of curvature of the conical recess 59*a* must be greater than the radius (D/2) of the ball 64 (see FIG. 7).

The shape of the recess 59*a* of the electrode pad 59 is not limited to conical and may be a shape that allows the ball 64 that has fallen from the top of the through-hole 62 to reliably move to one side and stop in the middle of the recess 59*a*, coming into contact with both the electrode pad 59 and the electrical wire 60 and to form a gap for allowing laser light to strike the portion of the electrode pad that is exposed to the laser light L.

Figure 9:
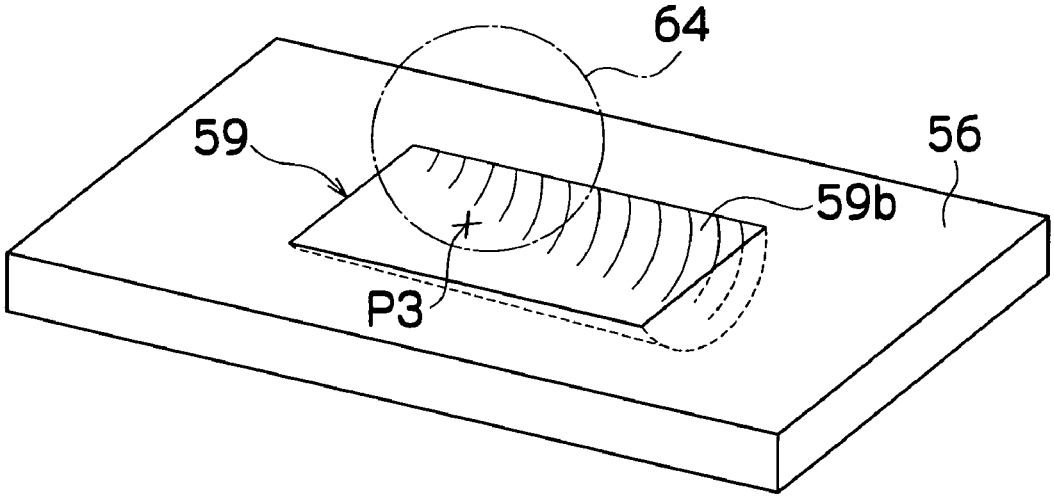
FIG. 9 is a perspective view showing another shape of a recess in an electrode connecting portion.
Figure 10:
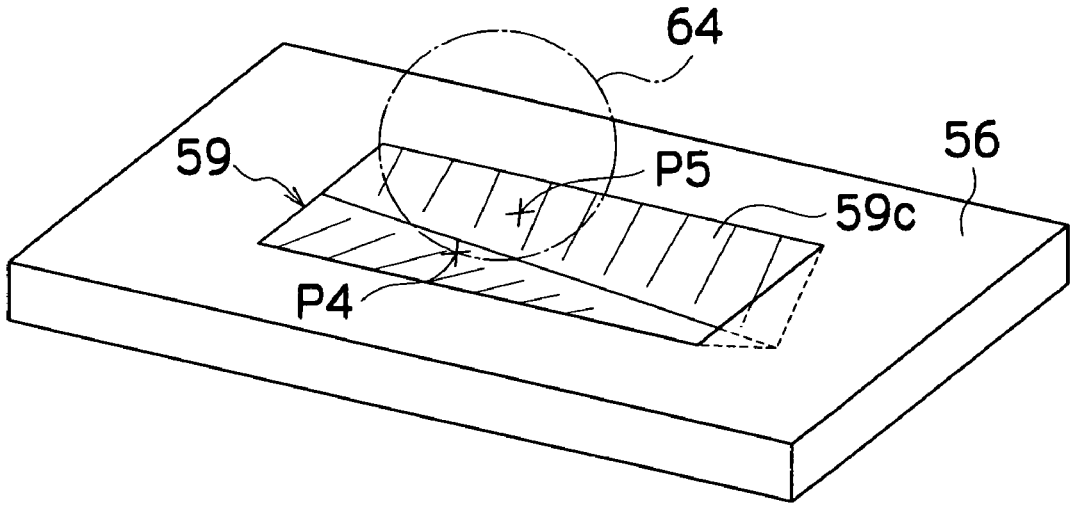
FIG. 10 is a perspective view similarly showing another shape of a recess in an electrode connecting portion.

For example, a recess 59*b* may be formed as a U-shaped groove that is inclined to one side as shown in FIG. 9, or a recess 59*c* may be formed as a V-shaped groove that is inclined to one side as shown in FIG. 10. When the recess is in the shape of a U as in FIG. 9, the ball 64 comes into contact with the recess 59*b* at the point P3 if the radius of curvature of the U shape is larger than the radius of the ball 64. Also, when the radius of curvature of the U shape is equal to the radius of the ball 64, the ball 64 and the recess 59*b* come into contact along a line, and when the radius of curvature of the U shape is less than the radius of the ball 64, the ball 64 comes into contact with the recess 59*b* at two points. In the case in FIG.

10, the ball 64 and the recess 59*c* will always come into contact at two points P4 and P5.

Next, the method for manufacturing a print head with such an electrode connecting portion will be described with reference to the flowchart in FIG. 11.

Figure 11:
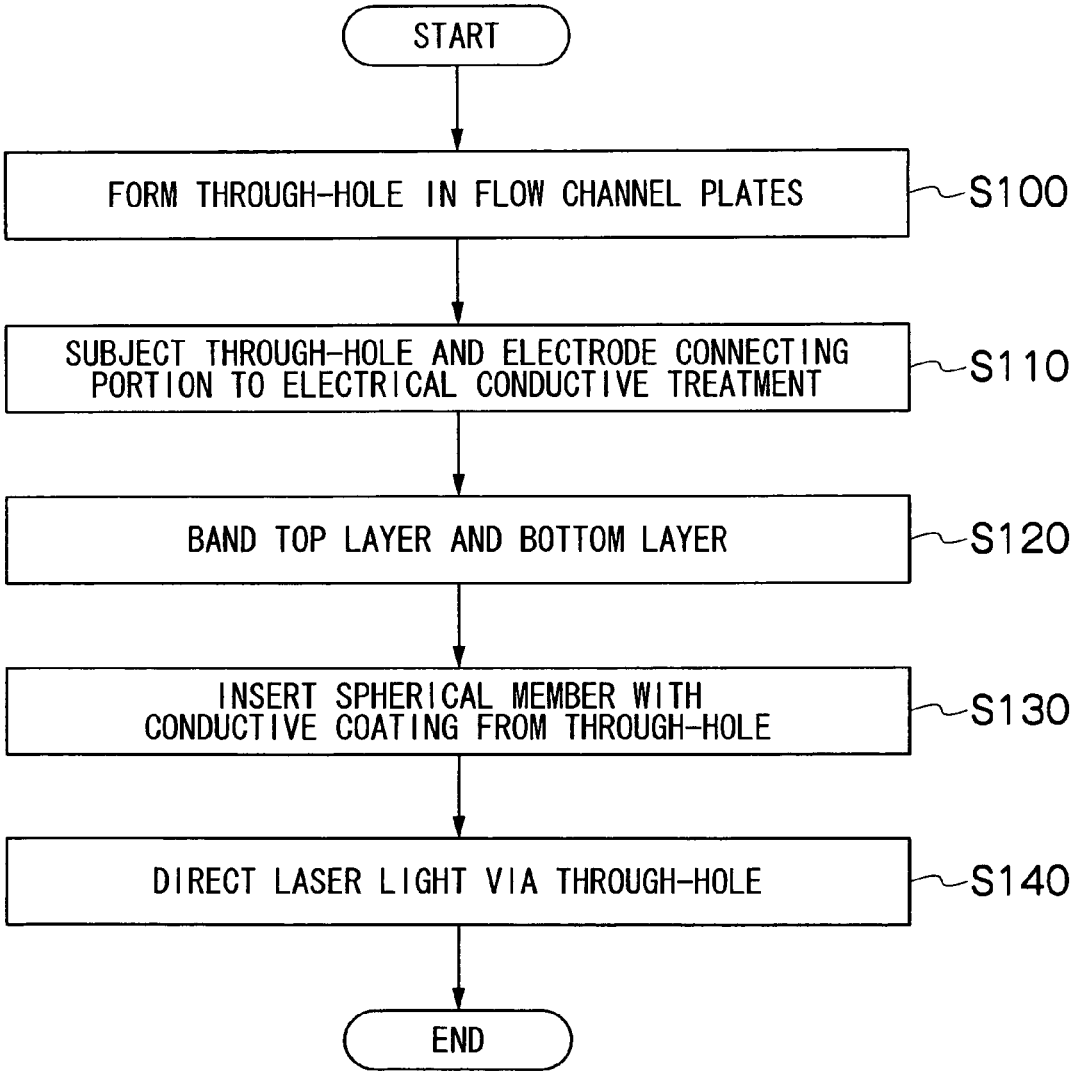
FIG. 11 is a flowchart showing the method for manufacturing the print head of the present embodiment.

First, in step S100 in FIG. 11, a through-hole 62 for forming a rod-shaped electrical wire 60 is formed in the flow channel plates 155 (and the base plate 162). At this time, a rib-shaped projection 155*b* is formed around the electrical wire 60 in the lowest plate 155*a* of the flow channel plates 155, as shown in FIGS. 6 and 7.

Next, in step S110, the flow channel plates 155 and the base plate 162 are bonded in layers, insulated against the inner walls of the through-hole 62, and coated with a plating 63 to ensure electrical conductivity, forming the top layer of the print head 50 composed of the base plate 162 and the flow channel plates 155 shown in FIG. 6 is formed. Also, the plates from the nozzle plate 151 to the piezo cover 158 shown in FIG. 6 are layered and bonded to form the bottom layers of the print head 50, the diaphragm 56 is subjected to insulation treatment and electrode sputtering, and the electrode pad 59 that forms the electrode connecting portion is formed. The electrode pad 59 also has a recess 59*a* such as is shown in FIG. 7.

Next, in step S120, the top layer and bottom layer of the print head 50 are bonded with an epoxy or another such adhesive. Next, in step S130, a ball (spherical member) 64 that has an electrically conductive coating on the surface (the solder plating 69) is inserted from the top of the through-hole 62.

The ball 64 inserted into the through-hole 62 moves downward along the incline after reaching the recess 59*a* of the electrode pad 59, but since the relationship in the inequality (1) is fulfilled between the diameter d of the through-hole 62, the diameter D of the ball 64, and the connection width W as previously described, the top of the ball 64 comes into contact with the projection 155*b* of the lowest plate 155*a*, and the ball 64 stops in the middle of the recess 59*a* and comes into contact at two points, the point P1 on the recess 59*b*, and the point P2 on the projection 155*b* as shown in FIG. 7. At this time, a gap 62*a* is formed where the ball 64 does not come into contact with the lowest plate 155*a*, as shown in FIG. 7.

Next, in step S140, the soldering applied to the surface of the ball 64 is melted by being irradiated with laser light L form the top of the through-hole 62, and the contact points are electrically connected in a reliable manner. An electrical connection is thereby reliably established between the electrical wire (through-hole wire) 60 configured from the plating 63 formed in the through-hole 62 of the flow channel plates 155, and the electrode pad 59 on the side of the piezoelectric element 58.

Thus, according to the present embodiment, the ball can be made to protrude reliably in one direction by forming a recess that satisfies the inequality (1) at a position offset from the through-hole in the electrode pad of the diaphragm. Also, since a gap is therefore formed between the ball and the through-hole, it is possible to form, via melted solder, a reliable electrical connection between the ball and the portions in contact with the flow channel plates and the electrode pad by directing laser light via the opening of the through-hole.

At this time, the conductive coating is not limited to the ball inserted into the through-hole, and solder plating (pre-soldering) may also be applied to the flow channel plates and diaphragm (electrode pad), or to all of the ball, the flow channel plates and the diaphragm. Also, the ball can be reliably made to protrude even if there are errors in the alignment between the inner walls of the through-hole in the flow plates and the electrode pad of the diaphragm by giving the inclined surface of the recess a long shape in one direction. Furthermore, the gap between the inner walls of the through-hole and the electrode pad can be reduced in size by forming a rib-shaped projection on the common flow plate at the lowest end of the through-hole, and a small spherical member can therefore be used and higher packaging density can be achieved.

Irradiation with laser light, which causes high temperature, is inadequate when the flow channel is made of a thermoplastic resin or other material with low thermal resistance. In such cases, therefore, it is possible to establish a reliable connection similar to irradiation with laser light by causing a conductive adhesive or the like to reliably flow over the top and bottom of the ball by adding the adhesive in drops from the opening of the through-hole, and then heating and drying the ball at a temperature equal to or less than the temperature limit of the thermoplastic resin. Furthermore, it is also possible to establish an electrical connection between the through-hole 62 and a hole 65 hereinafter described by forming an electrically conductive pattern that utilizes nanoprinting or another technique.

Also, in the embodiment described above, a connection of an electrical wire for supplying a drive signal to a piezoelectric element has been described, but when a sensor plate such as one that forms part of a pressure chamber is disposed to determine the pressure in the pressure chamber, a wire (sensor rod) for receiving the determination signal can be similarly formed in a rod shape, and the electrical connection can be established using a ball similar to the descriptions above.

Figure 12:
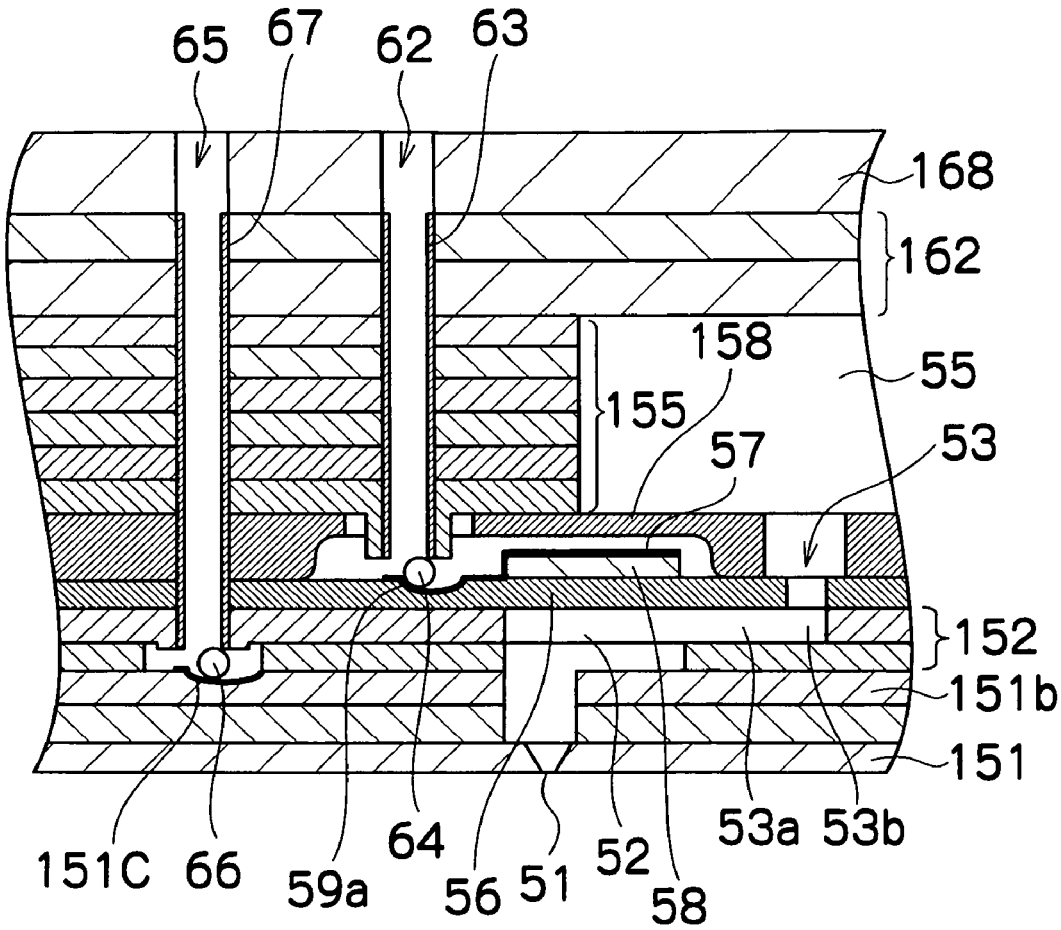
FIG. 12 is a cross-sectional view showing an enlargement of an electrode connecting portion from a pressure determination element.

For example, as shown in FIG. 12, a sensor plate 151*b* that functions as a pressure determining element (pressure determination sensor) for determining the pressure in the pressure chambers 52 is disposed to form the bottom surface of the pressure chambers 52. The sensor plate 151*b* can suitably be formed by layering PVDF, for example, over stainless steel. The through-hole 65 that will form the electrical wire for receiving the pressure determination signal from the sensor plate 151*b* goes all the way through the common liquid chamber 55 similar to the through-hole 62 and faces the front and back of the PVDF (not shown in the diagram) so as to stand substantially perpendicular from the electrode pad (connecting portion) 151*c* provided to the sensor plate 151*b*.

Also, the inner surface of the through-hole 65 is insulated in the same manner as the through-hole 62 and is rendered electrically conductive by a plating 67, for example. Thus, a tube-shaped electrical wire (through-hole wire) that is hollow in the middle is formed by a plating 67 applied to the inner wall of the through-hole 65. Also, a rib-shaped projection is formed surrounding the through-hole 65 of the pressure chamber plate 152 on the sensor plate 151*b*.

A connection is obtained with both the electrode pad 151*c* next to the sensor plate 151*b* and the plating 67 section next to the through-hole 65 by inserting a spherical member (for example, a ball of which surface has been solder plated) 66 with a conductive coating into the through-hole 65 from above.

At this time, a conical recess is formed in the electrode pad 151*c* so that the ball 66 reliably comes into contact with both the lowest end of the through-hole 65 and the electrode pad 151*c* of the sensor plate 151*b* in the portion of the electrode pad 151*c* on the sensor plate 151*b*. An electrical connection can thereby be obtained similar to the connection between the piezoelectric element 58 and the through-hole 62 described above.

Thus, when the sensor plate 151*b* is provided to determine ejection by determining the internal pressure, the print determination unit 24 that determines ejection from outside the print head may be omitted.

As another embodiment, the connection obtained when the electrical wire is pulled in a perpendicular direction can be established without rendering the through-hole electrically conductive, by using a plurality of spherical members (balls) that have a conductive coating as in the present embodiment.

Figure 13:
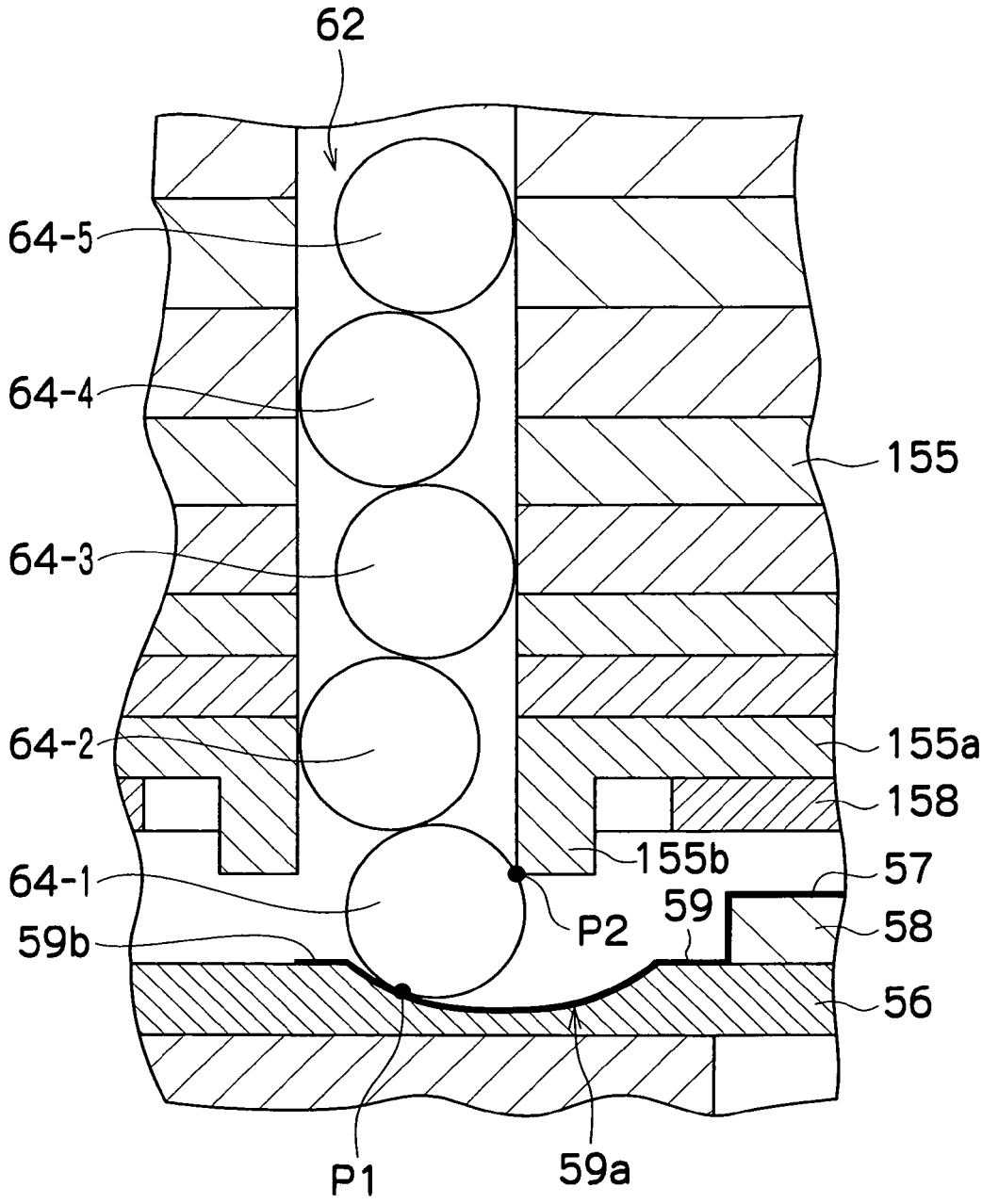
FIG. 13 is an expanded cross-sectional view showing an example in which electrodes are connected by a plurality of spherical members having conductive coatings.

FIG. 13 shows such an example. FIG. 13 is an expanded cross-sectional view showing an electrical connecting portion with a piezoelectric element in the same manner as in FIG. 7. Components in FIG. 13 that are similar to those in FIG. 7 are denoted by the same reference numerals in FIG. 7.

As shown in FIG. 13, this embodiment is identical to the example shown in FIG. 7, except that the inner wall of the through-hole 62 formed in the flow channel plates 155 is not rendered electrically conductive. Specifically, the lowest plate 155*a* of the through-hole 62, for example, has a projection formed around the through-hole 62 in the same manner as in FIG. 7, and reliably comes into contact with the inserted ball. Also, a conical recess 59*a* is formed in the electrode pad 59 that is brought out from the individual electrode 57 of the piezoelectric element 58 at the bottom of the through-hole 62, to ensure that the lowest point of the through-hole 62 will be slightly misaligned from the axial line thereof. The ball 64-1 that comes into contact with the recess 59*a* is thereby moved towards the lowest point of the recess 59*a* when the ball 64-1 is inserted from above. The ball then comes into contact with the bottom end of the through-hole 65 in the middle and stops in that area.

The present embodiment differs from the example in FIG. 7 in that since the inner wall of the through-hole 62 is not subjected to electrically conductive treatment, an electrical connection with the piezoelectric element 58 is obtained by inserting a plurality of balls with conductive coatings (spherical members having conductive coatings) 64-1, 64-2, 64-3, 64-4, 64-5, etc. into the through-hole 62. The shape of the balls (64-1 etc.) is similar to the example shown in FIG. 7, and at least the ball 64-1 is designed so that the above-described inequality (1) is satisfied.

Next will be described a method for manufacturing a print head in which an electrical wire is formed by inserting a plurality of balls with a conductive coating into a through-hole to obtain an electrical connection.

Figure 14:
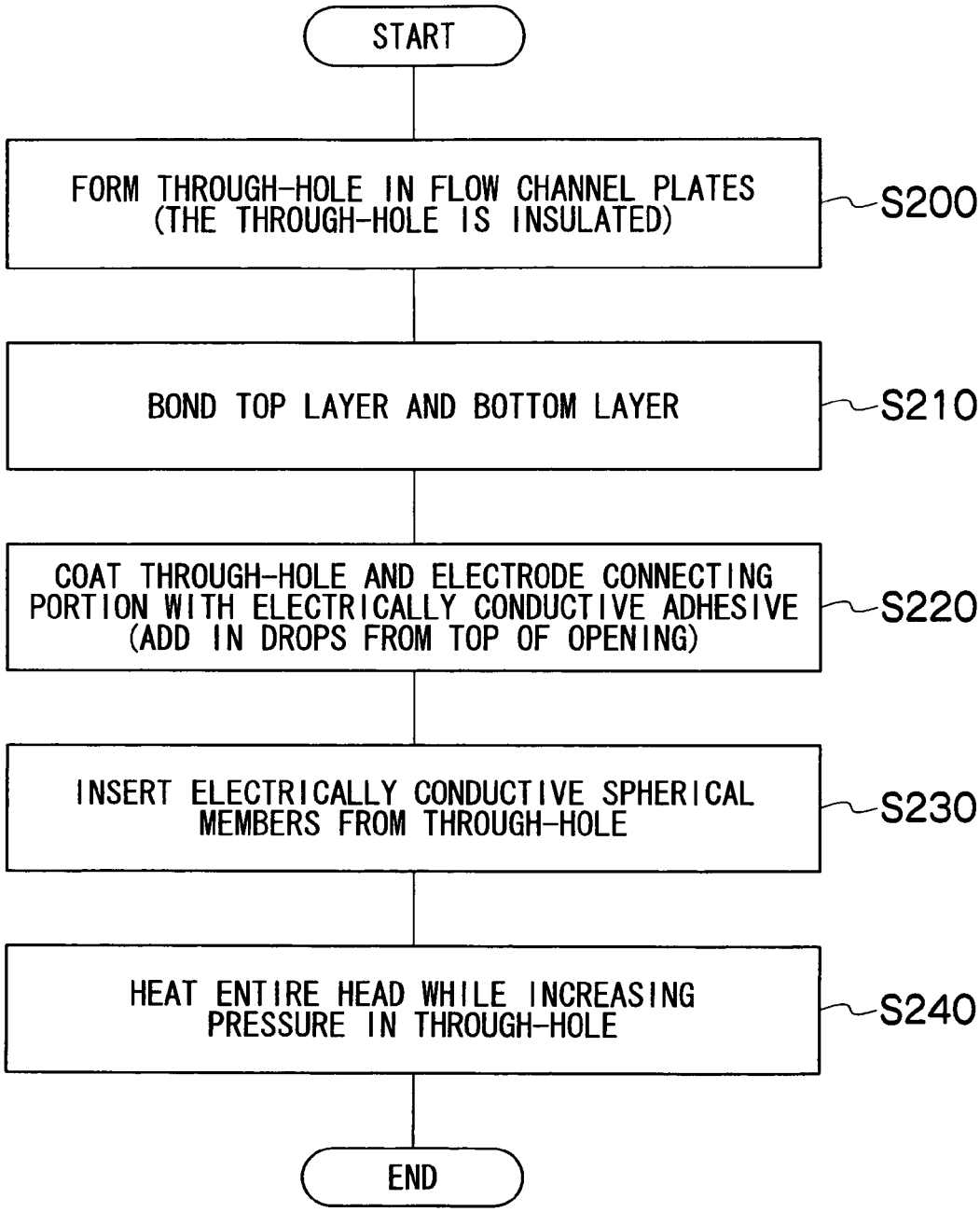
FIG. 14 is a flowchart showing a method for manufacturing a print head using a plurality of spherical members having conductive coatings.

FIG. 14 shows a flowchart of the method for manufacturing such a print head.

In step S200 in FIG. 14, first a through-hole 62 is formed in the flow channel plates 155 that form (the partition walls of) a common liquid chamber. The through-hole 62 is subjected to insulating treatment as necessary.

Next, step S210 entails bonding the top layer of the print head that includes the separately formed common liquid chamber, and the bottom layer that includes the pressure chambers.

Next, in step S220, the through-hole 62 and the nozzle flow channel plate 151*a* or another such electrode connecting portion are coated with an electrically conductive adhesive. This may be achieved by adding the electrically conductive adhesive in drops from the top of the opening of the through-hole 62. The electrically conductive adhesive may also be applied through a hollow needle inserted to the through-hole 62 as necessary.

Next, in step S230, a plurality of balls (spherical members) 64-1 through 64-5 with electrically conductive coatings are inserted via the through-hole 62.

An electrical connection is then established by heating the entire print heat and curing the adhesive while increasing the pressure to the through-hole 62 to reliably bond the balls 64-1 and the like. In order to increase the pressure in the through-hole 62, it is possible that the balls 64 are inserted so as to the last (top) ball 64 protrudes from the base plate 162, an elastic tool is pressed on the top ball 64, and a multilayered flexible cable with an opening provided to a position corresponding to the through-hole 62 is connected. Also, the through-hole 62 may be coated with an electrically conductive adhesive after the ball 64 is inserted.

The balls 64-1 and the like with electrically conductive coatings may be inserted one by one from the through-hole 62, and the step of exposure to laser light may be repeated for each ball.

Thus, it is possible to bring out electrodes form the piezoelectric element side even if the through-hole is not electrically conductive, by using a plurality of electrically conductive spherical members. It is also possible to reduce electrical resistance in comparison with cases in which an electrically conductive adhesive is filled.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of ejection ports which eject liquid;

a plurality of pressure chambers which respectively communicate with the ejection ports;

a plurality of piezoelectric elements which respectively deform the plurality of pressure chambers and are provided to faces of the pressure chambers opposite to faces on which the ejection ports are formed;

a common liquid chamber which supplies the liquid to the plurality of pressure chambers and is formed on a side of the piezoelectric element opposite to the pressure chamber;

a plurality of through-hole wires which stand substantially perpendicular to the faces on which the piezoelectric elements are mounted, the through-hole wires running through a partition wall of the common liquid chamber and being electrically connected to the piezoelectric elements in connecting portions, respectively; and a spherical member which has a conductive coating and is disposed in each of the connecting portions, wherein a recess is formed on a side of the piezoelectric element facing the through-hole wire in each of the connecting portions.

2. The liquid ejection head as defined in claim 1, wherein a center position of the recess is placed a specific distance from an axial position of the through-hole wire.

3. The liquid ejection head as defined in claim 1, wherein an inequality $W<D<d$ is satisfied between a diameter d of a through-hole formed in the partition wall of the common liquid chamber in which the through-hole wire is formed, a diameter D of the spherical member, and a connecting width W which is a distance between a point at which the spherical member is in contact with the piezoelectric element in the connecting portion, and a point at which the spherical member is in contact with the through-hole wire in the connecting portion.

4. The liquid ejection head as defined in claim 1, wherein a portion in which the through-hole wire comes into contact with the spherical member has a projection shape.

5. A liquid ejection head, comprising:

a plurality of ejection ports which eject liquid;

a plurality of pressure chambers which respectively communicate with the ejection ports;

a plurality of piezoelectric elements which respectively deform the plurality of pressure chambers and are provided to faces of the pressure chambers opposite to faces on which the ejection ports are formed;

a common liquid chamber which supplies the liquid to the plurality of pressure chambers and is formed on a side of the piezoelectric element opposite to the pressure chamber;

a plurality of through-holes which stand from connecting portions of the piezoelectric elements substantially perpendicularly to the faces on which the piezoelectric elements are mounted, the through-holes running through a partition wall of the common liquid chamber; and a plurality of spherical members which are disposed in each of the through-holes, each of the spherical members having a conductive coating, wherein a recess is formed on a side of the piezoelectric element facing the through-hole in each of the connecting portions.

6. A liquid ejection head, comprising:

a plurality of ejection ports which eject liquid;

a plurality of pressure chambers which respectively communicate with the ejection ports;

a plurality of piezoelectric elements which respectively deform the plurality of pressure chambers and are provided to faces of the pressure chambers opposite to faces on which the ejection ports are formed;

a common liquid chamber which supplies the liquid to the plurality of pressure chambers and is formed on a side of the piezoelectric element opposite to the pressure chamber;

a plurality of pressure determination elements which determine pressure in the pressure chambers, respectively;

a plurality of through-hole wires which stand substantially perpendicular to the faces on which the piezoelectric elements are mounted, the through-hole wires running through a partition wall of the common liquid chamber and being electrically connected to the pressure determination elements in connecting portions, respectively; and a spherical member which has a conductive coating and is disposed in each of the connecting portions, wherein a recess is formed on a side of the pressure determination element facing the through-hole wire in each of the connecting portions.

7. A liquid ejection head, comprising:

a plurality of ejection ports which eject liquid;

a plurality of pressure chambers which respectively communicate with the ejection ports;

a plurality of piezoelectric elements which respectively deform the plurality of pressure chambers and are provided to faces of the pressure chambers opposite to faces on which the ejection ports are formed;

a common liquid chamber which supplies the liquid to the plurality of pressure chambers and is formed on a side of the piezoelectric element opposite to the pressure chamber;

a plurality of pressure determination elements which determine pressure in the pressure chambers, respectively;

a plurality of through-holes which stand from connecting portions of the pressure determination elements substantially perpendicularly to the faces on which the piezoelectric elements are mounted, the through-holes running through a partition wall of the common liquid chamber; and a plurality of spherical members which are disposed in each of the through-holes, each of the spherical members having a conductive coating, wherein a recess is formed on a side of the pressure determination element facing the through-hole in each of the connecting portions.

8. A liquid ejection head, comprising:

a plurality of ejection ports which eject liquid;

a plurality of pressure chambers which respectively communicate with the ejection ports;

a plurality of piezoelectric elements which respectively deform the plurality of pressure chambers and are provided to faces of the pressure chambers opposite to faces on which the ejection ports are formed;

a common liquid chamber which supplies the liquid to the plurality of pressure chambers and is formed on a side of the piezoelectric element opposite to the pressure chamber;

a plurality of through-holes which stand substantially perpendicular to the faces on which the piezoelectric elements are mounted, the through-holes running through a partition wall of the common liquid chamber and being electrically connected to the piezoelectric elements in connecting portions, respectively;

a conductive path through each through-hole for supplying a signal to drive the piezoelectric element; and a spherical member which has a conductive coating and is disposed in each of the connecting portions, wherein a recess is formed on a side of the piezoelectric element facing the through-hole wire in each of the connecting portions.

9. The liquid ejection head as defined in claim 8, wherein the conductive path includes a conductive coating on inside perimeter of the through-hole.

10. The liquid ejection head as defined in claim 8, wherein the conductive path includes a plurality of spherical members.

* * * * *